US008146903B2

(12) United States Patent
Ryan

(10) Patent No.: US 8,146,903 B2
(45) Date of Patent: Apr. 3, 2012

(54) BOOKLET MAKER WITH SPACED CREASE ROLLERS

(75) Inventor: Jeffrey W. Ryan, Knebworth (GB)

(73) Assignee: Xerox Corporation, Norwalk, CT (US)

( * ) Notice: Subject to any disclaimer, the term of this patent is extended or adjusted under 35 U.S.C. 154(b) by 601 days.

(21) Appl. No.: 12/257,794

(22) Filed: Oct. 24, 2008

(65) Prior Publication Data

US 2010/0104399 A1 Apr. 29, 2010

(51) Int. Cl.

| | |
|---|---|
| ***B41L 43/12*** | (2006.01) |
| ***B42C 13/00*** | (2006.01) |
| ***G03G 15/00*** | (2006.01) |
| ***B31F 1/08*** | (2006.01) |
| ***B31F 1/10*** | (2006.01) |

(52) U.S. Cl. ..... 270/37; 412/22; 399/410; 493/424; 493/444; 493/445

(58) Field of Classification Search ..... 412/22; 399/410; 493/424, 434, 444, 445; 270/45, 270/37

See application file for complete search history.

(56) References Cited

U.S. PATENT DOCUMENTS

| | | | | |
|---|---|---|---|---|
| 308,214 | A * | 11/1884 | Stonemetz | 493/445 |
| 1,693,147 | A * | 11/1928 | King | 412/22 |
| 6,162,316 | A * | 12/2000 | Spitler et al. | 270/45 |
| 6,394,441 | B1 * | 5/2002 | Cruz et al. | 493/424 |
| 6,602,176 | B1 * | 8/2003 | Ganneval | 493/424 |
| 6,799,759 | B1 | 10/2004 | McNamara et al. | |
| 6,939,283 | B2 | 9/2005 | Sparano et al. | |
| 6,981,938 | B2 | 1/2006 | Ruthenberg et al. | |
| 2008/0211158 | A1 * | 9/2008 | Fukasawa et al. | 270/37 |

* cited by examiner

*Primary Examiner* — Dana Ross
*Assistant Examiner* — Kyle Grabowski
(74) *Attorney, Agent, or Firm* — Hoffmann & Baron, LLP

(57) ABSTRACT

Embodiments described herein include as apparatus for folding printed sheets. The apparatus including first crease roller and a second crease roller longitudinally aligned with the first crease roller. A spacing device separating the first and second crease rollers to form a nip space therebetween. A crease blade is disposed adjacent the nip space and adapted to urge the sheets toward the nip space.

15 Claims, 4 Drawing Sheets

BOOKLET MAKER WITH SPACED CREASE ROLLERS

BACKGROUND

1. Technical Field

The present disclosure relates to automated booklet makers, in which sheets forming a booklet are folded by passing through a pair of crease rollers.

2. Brief Discussion of Related Art

Booklet makers are well-known devices for forming folded booklets which are stapled along the crease thereof. It is becoming common to include booklet makers in conjunction with office-range printers. The word "printer" as used herein encompasses any apparatus, such as a copier, digital copier, bookmaking machine, facsimile machine, multifunction machine, etc. which performs a print outputting function for any purpose. In basic form, a booklet maker includes a slot for accumulating processed sheets, as would be produced by a printer. The accumulated sheets, forming the pages of a booklet, are positioned within the stack so that a stapler mechanism and complementary anvil can staple the stack precisely along the intended crease line. The creased and stapled sheet sets are then pushed, by a blade, completely through crease rollers, to form the final main fold in the finished booklet. The finished booklets are then accumulated in a tray downstream of the crease rollers.

Crease rollers of a booklet maker are typically urged together under spring tension and roll against each other prior to the entry of the booklet. As the booklet enters the nip, the rollers are separated. The tension is then transferred to the booklet and helps form the booklet crease. In the process of forming a booklet, the friction between the outer sheet, which physically contacts the crease rollers, and the underlying sheet helps to stabilize the outer sheet as enters the crease rollers and is folded and creased. This inter-sheet friction is influenced by such factors as the surface roughness of the sheets and the print material used to create the image on the sheets. Due to variations in surface roughness of sheets and the print material, the friction between the outer sheet and the underlying sheet may not be sufficient. Therefore, the top sheet may be torn or otherwise damaged as it passes through the crease rollers. Such tear off damage typically leads to a jam which requires clearing by an operator and significantly slows the booklet making process.

Accordingly, it would be desirable to provide a booklet maker which reliably provides a satisfactory crease while maintaining the integrity and quality of the booklet.

SUMMARY

According to aspects illustrated herein, there is provided as apparatus for folding printed sheets. The apparatus including a first crease roller and a second crease roller longitudinally aligned with the first crease roller. A spacing device separates the first and second crease rollers to form a nip space therebetween. A crease blade is disposed adjacent the nip space and is adapted to urge the sheets toward the nip space.

According to other aspects illustrated herein, there is provided a booklet maker including a first crease roller and a second crease roller. The first crease roller and second crease roller are arranged in longitudinal alignment with each other. A biasing device is provided for urging the first and second crease rollers toward each other. A spacing device is disposed on at least one of the first and second crease rollers. The spacing device maintains a minimum nip space between the first and second crease rollers. A movable crease blade is disposed adjacent the nip space.

According to further aspects illustrated herein, there is provided a method of forming a booklet including:

obtaining a first and a second crease roller forming a first set of crease rollers;

obtaining a spacing device, the first and second rollers being spaced from each other to create a nip space therebetween;

obtaining a crease blade movable into the nip space;

collecting a plurality of sheets; and engaging the plurality of sheets with the crease blade and moving the plurality of sheets into the nip space.

DETAILED DESCRIPTION

Exemplary embodiments include a booklet maker including crease rollers for forming booklets. The booklet maker can include a movable crease blade positioned adjacent a pair of crease rollers for forming a crease in processed sheets. The crease rollers can be spaced from each other to permit the entry of the sheets therebetween.

As used herein, "booklet maker" refers to a device that operates on substrate media such as sheets of paper to form a booklet of folded sheets secured together.

As used herein, "crease roller" refers to a rotating longitudinally extending device for engaging substrate media to form a bend therein.

As used herein, "crease blade" refers to a member engagable with substrate media to assist in forming a bend therein.

As used herein, "spacing device" refers to a member for maintaining a space between components such as crease rollers.

As used herein, "nip space" refers to the space or opening between rollers.

As used herein, "pitch ring" refers to an annular device for setting the spacing between two components.

Figure 1:
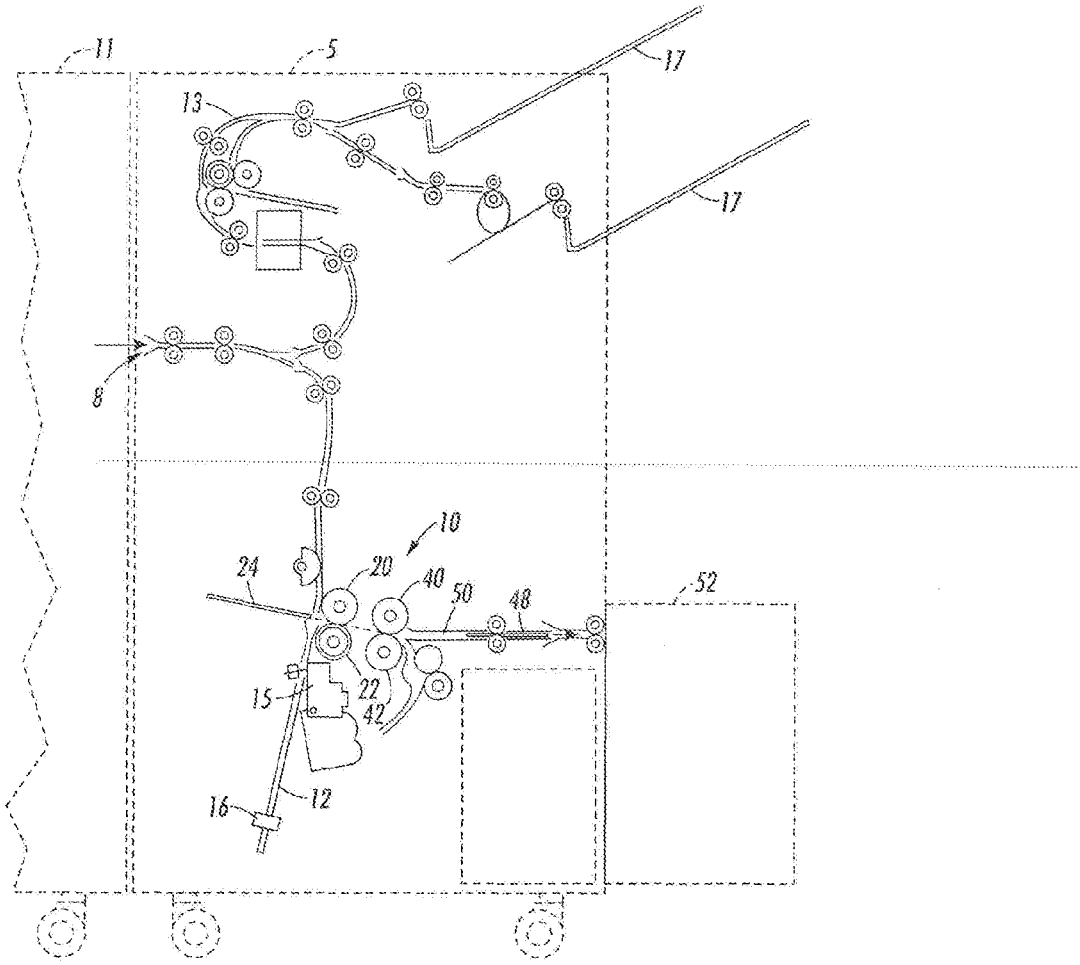
FIG. 1 is a simplified elevational view of a finisher module as would be used with a printer.

FIG. 1 is a simplified elevational view of a finisher module, generally indicated as 5, including a booklet maker 10, as would be used with an office-range printer. Printed sheets from the printer 11 are accepted in an entry port 8. Depending on the specific design of finisher module 5, there may be numerous paths such as 13 and numerous output trays 17 for print sheets, corresponding to different desired actions, such as stapling, hole-punching and C- or Z-folding. It is to be understood that the various rollers and other devices which contact and handle sheets within finisher module 5 are driven by various motors, solenoids and other electromechanical devices (not shown), under a control system, such as including a microprocessor (not shown), within the finisher module 5, printer 11, or elsewhere, in a manner generally familiar in the art. For present purposes what is of interest is the booklet maker generally indicated as 10.

Booklet maker 10 defines a "slot" which is here indicated as 12. Slot 12 accumulates processed sheets 14 from the printer 11 forming a sheet set. The sheets may be signature sheets (sheets each having four page images thereon, for eventual folding into pages of the booklet). Each sheet is held within slot 12. There is provided at the bottom of slot 12 an elevator 16, which forms the "floor" of the slot 12 on which the edges of the accumulating sheets rest before they are further processed. In order to receive the sheets from the printer, the elevator 16 is placed at different locations along slot 12 depending on the size of the incoming sheets. The elevator 16 also moves the sheets to different locations so they may be processed, such as stapled and creased to form a booklet.

As printed sheets are output from printer 11, elevator 16 is positioned so that the trailing edge of the sheets 14 (which would be at the top of slot 12) are disposed above a first pair of crease rollers 20, 22. When all of the necessary sheets to form a desired booklet are accumulated in slot 12, elevator 16 is moved from its first position to a second position where the midpoint of the sheets are adjacent the stapler 15. Stapler 15 is activated to place one or more staples along the midpoint of the sheets, where the booklet will eventually be folded.

Figure 2:
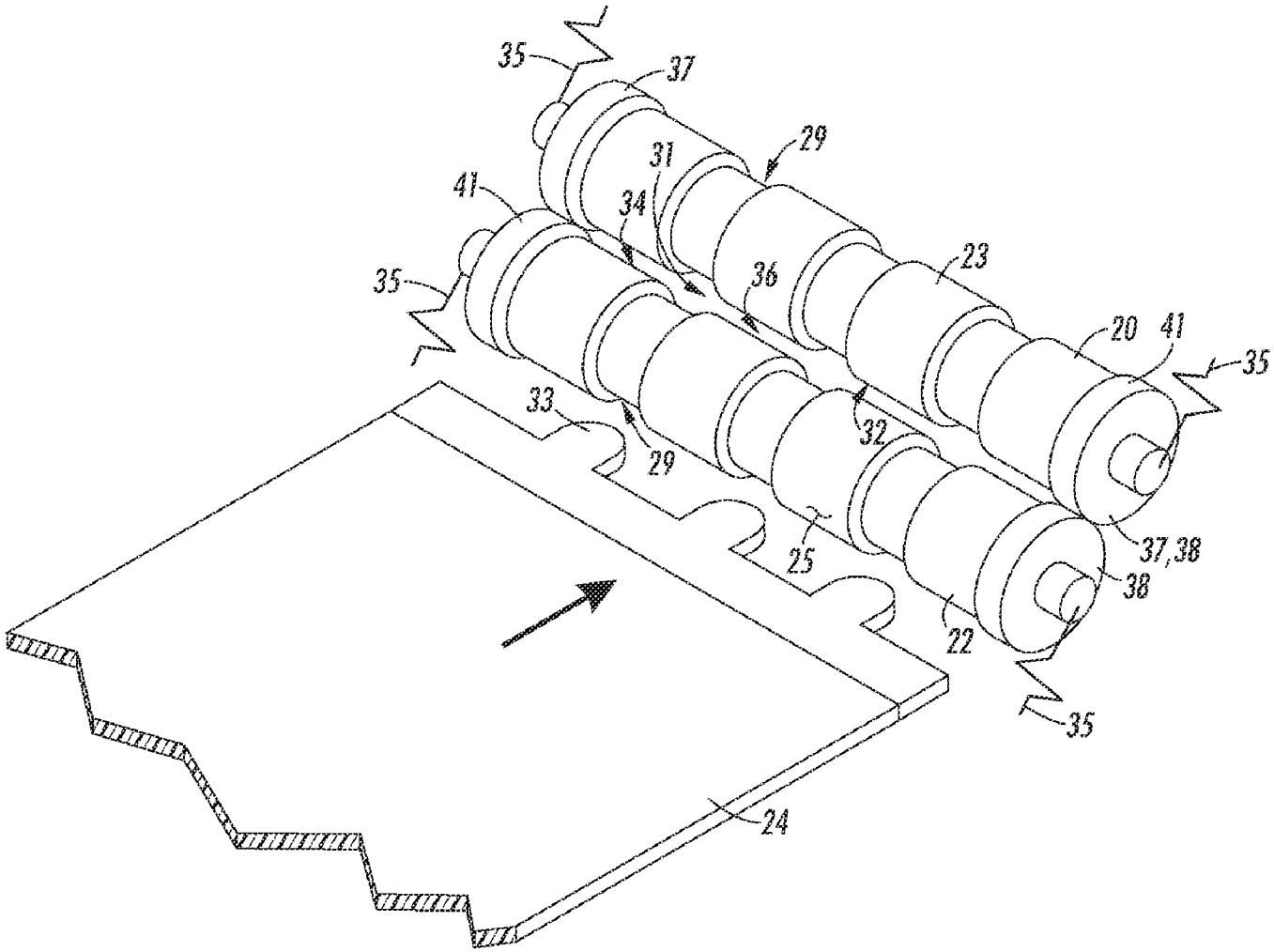
FIG. 2 is a perspective view of a booklet maker of the finisher module.
Figure 3:
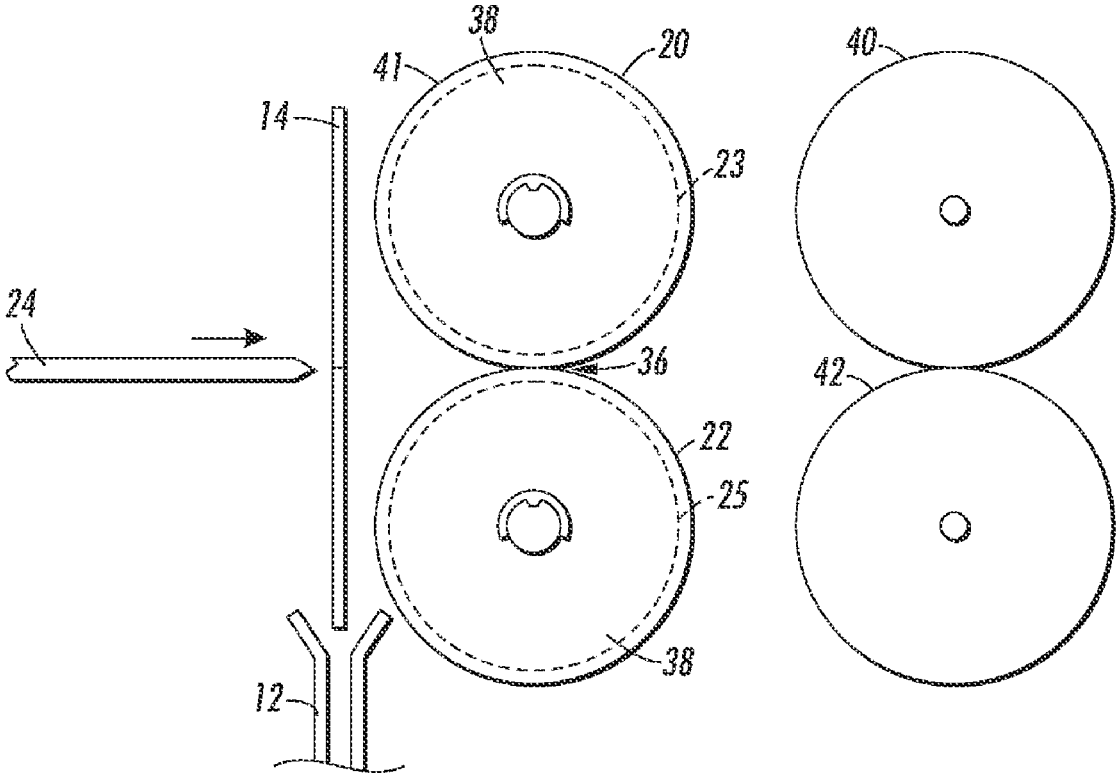
FIG. 3 is an elevational view of crease rollers prior to acting on a sheet set.

With reference to FIGS. 2 and 3, after the stapling is performed, elevator 16 is moved from its second position to a third position, thereby moving the sheets 14 to a creasing position. In this position, the midpoint of the sheets are adjacent a crease blade 24 and the first set of crease rollers 20 and 22. The action of blade 24 and crease rollers 20 and 22 performs the initial folding and creasing of the sheets into a booklet. A second set of crease rollers 40 and 42 disposed downstream of the first set of crease roller create a sharp crease to form the finished booklet.

Crease rollers 20 and 22 are longitudinally aligned with each other in a parallel relationship and supported at their ends to permit rotary motion. The crease rollers 20 and 22 may be operatively connected to a drive mechanism (not shown) which selectively rotates the crease rollers to draw in the sheets. The crease rollers 20 and 22 may have outer surfaces 23 and 25, respectively, formed of a resilient material which helps grip the sheets 14. Crease rollers 20 and 22 may have segmented outer surfaces including grooves 29 formed therein. The grooves 29 of crease rollers 20 and 22 align with each other to form a plurality of gaps 31 along the length of the crease rollers.

The crease rollers 20 and 22 are translatable with respect to each other and are biased toward an initial position, as shown schematically in FIG. 2 by biasing devices 35. Crease blade 24 may include a plurality of projections 33 forming the distal end of the blade 24. Projections 33 are configured such that they extend into the gaps 31 between the crease rollers formed by the roller grooves 29. As the sheet set 14 is pushed between the crease rollers 20 and 22 by the crease blade 24, the crease rollers may translate away from each other in a radial direction against the action of the biasing device 35. The crease rollers 20 and 22 maintain a tension on the sheets 14 to form a creased booklet. The radial translation of the crease rollers 20 and 22 permit booklets of varying number of sheets to be properly creased.

Figure 5:
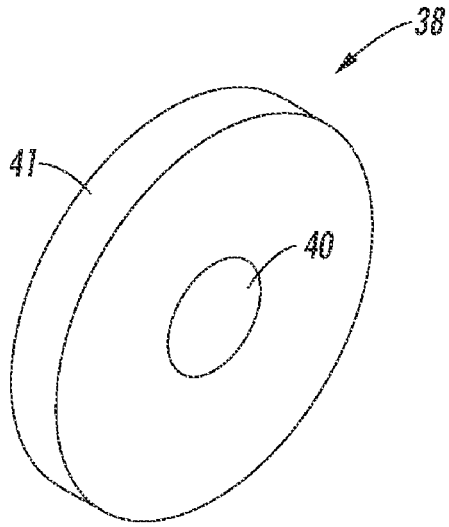
FIG. 5. is a perspective view of a spacing device.

With reference to FIGS. 2 and 5, the crease rollers 20 and 22 may have an initial position wherein their longitudinal edges 32 and 34 are spaced from each other resulting in a nip space 36. The nip space 36 may extend along at least a length of the crease rollers corresponding to the portion of the length through which the sheets travel. Accordingly, the crease rollers 20 and 22 do not touch each other along this length. The nip space 36 may be approximately 0.6 mm. The nip space 36 may, for example, be in the range of about 0.3 to about 2 mm. The nip space selected may depend on the thickness of the sheets and the number of sheets which may be processed through the booklet maker 10. The nip space 36 is created by way of a spacing device 37. Spacing device 37 may be disposed between the crease rollers 20 and 22 to maintain the minimum spacing between the rollers. Spacing device 37 may include a plurality of pitch rings 38. Pitch rings 38 may include disc-like annular devices disposed on and operatively secured to each end of the crease rollers 20 and 22. The pitch rings 38 are sized diametrically such that they roll against each other to maintain the desired nip spacing.

The pitch rings 38 may have a central opening 40 to permit a portion of the crease roller to which it is attached to extend therethrough. Pitch rings 38 may also include an outer circumference 41 which rollingly engages the outer circumference of the opposed pitch ring 38. The diameter of the pitch rings may be greater than the diameter of the crease rollers 20 and 22 such that the rings ride on each other. The diameter may be selected to achieve the desired nip space 36. For example, each pitch ring may have a diameter 0.3 mm greater than the diameter of the crease roller to which it is attached. The combination of pitch rings on the two crease rollers would result in a nip space of 0.6 mm.

Pitch rings 38 may be formed separately of the crease rollers 20 and 22, or alternatively, be formed as part of the roller itself. In an alternative embodiment, only one of the rollers may include pitch rings. In this embodiment, the pitch rings of one crease roller would ride on the other crease roller, thereby creating the nip space between the two crease rollers.

Figure 4:
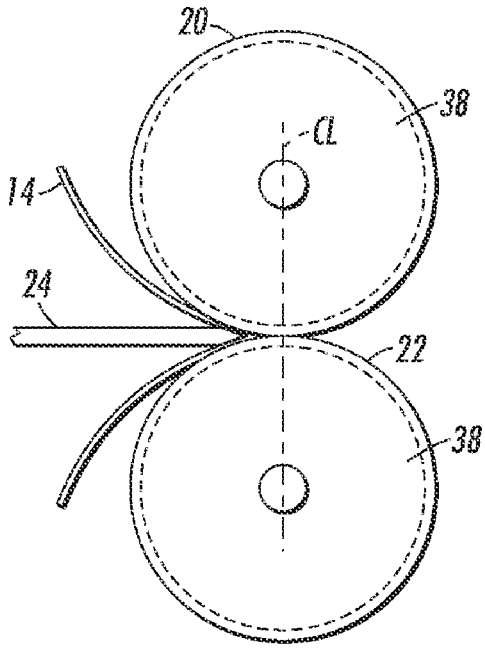
FIG. 4 is an elevational view of crease rollers acting on a sheet set.

FIG. 3 shows crease blade 24 in a first, withdrawn position, where sheet set 14 to be folded into a booklet is loaded in slot 12, upstream of the nip 36 along a process direction. With reference to FIG. 4, when a set of sheets 14 is ready to be creased, the crease blade 24 is advanced such that the crease blade projections 33 contact the sheets 14 along a stapled midpoint thereof, and pushes the sheets toward and into the nip space 36. The crease rollers 20 and 22 are rotating. When the top sheet engages the spaced crease rollers 20 and 22, the crease blade 24 continues to push the sheets through the first set of crease rollers. The crease blade 24 may be advanced up to and past the centerline, CL, of the nip 36. The centerline CL may be defined by a line extending through the axis of rotation of the crease rollers 20 and 22 as shown in FIG. 3. With the crease rollers 20 and 22 spaced to begin with by the spacing device 37, the load exerted on the top sheet is reduced since the sheets 14 do not have to initially separate the crease rollers. Therefore, the chance of tear off of the top sheet by the crease rollers is reduced. Additionally, as the sheets 14 enter the spaced nip between the crease rollers 20 and 22 and the outer sheet is grabbed by the crease rollers, the crease blade 24 is still pushing the sheets. Therefore, the movement of the sheets 14 during the initial forming of the crease by the crease rollers 20 and 22 is not solely due to the rotation of the crease rollers acting on the outer sheet. After the crease blade 24 has reached its forward-most position, the folded sheets 14 are drawn through nip 36 by frictional engagement with the rotating crease rollers 20 and 22.

With reference to FIGS. 1 and 3, the booklet maker may further include a second set of crease rollers 40 and 42 for providing a fine crease to the folded set of sheets 14 to form the finished booklet. Crease rollers 40 and 42 may be disposed downstream of and adjacent to the first set of crease rollers. Crease rollers 40 and 42 may have an initial position in which they engage each other along their length. When the folded sheets engages the second set of rollers, the booklet is drawn through the rollers and the crease is fully formed. Second set of rollers 40 and 42 may be translatable relative to each other in a radial direction. The rollers may, therefore, separate from each other as the sheets passes through the rollers. This allows booklets of varying thicknesses to be processed. A biasing device (not shown), which tends to urge the rollers together, assists in forming the fine crease. The finished booklets 48 are then conducted along path 50 and collected in a tray 52.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. An apparatus for folding sheets comprising:

a first crease roller having a first and second end;

a second crease roller longitudinally aligned with the first crease roller, the first and second crease rollers each having segmented outer surfaces including grooves formed therein, the grooves of the first crease roller aligning with the grooves of the second crease roller to form a plurality of gaps along the length of the first and second crease rollers;

a spacing device including a plurality of pitch rings and one of the plurality of the pitch rings is disposed on each of the first and second ends of the first crease roller, the pitch rings separating the first and second crease rollers to form a nip space between the outer surfaces of the first and second crease rollers, the nip space extending along a length of the first and second crease rollers, such that the first and second crease rollers do not engage each other along an entire portion of the first and second crease rollers extending between the pitch rings; and a crease blade disposed adjacent the nip space and adapted to urge the sheets toward the nip space, the crease blade having a plurality of projections extending therefrom, the projections being aligned with and extending into the plurality of gaps.

2. The apparatus of claim 1, wherein the first and second crease rollers have a longitudinally extending outer surface, and the nip space is formed between the outer surfaces of the first and second crease rollers.

3. The apparatus of claim 1, wherein the spacing device includes an annular member disposed on one of the first and second crease rollers and engaging the other of the first and second crease rollers.

4. The apparatus of claim 1, wherein the second crease roller includes a first and second end, and one of the plurality of pitch rings is disposed on each of the first and second ends of the second crease roller.

5. The apparatus of claim 1, wherein the pitch rings disposed on the first crease roller engage the pitch rings disposed on the second crease roller.

6. The apparatus of claim 1, wherein the nip space between adjacent non-grooved portions of the first and second crease rollers is in the range of about 0.3 mm to about 2 mm.

7. The apparatus of claim 6, wherein the nip space between the adjacent non-grooved portions of the first and second crease rollers is about 0.6 mm.

8. The apparatus of claim 1, wherein the first and second crease rollers include an axis of rotation which defines therebetween a nip centerline, and wherein the crease blade is movable into the nip space beyond the centerline.

9. The apparatus of claim 1, further including a pair of biasing devices operably connected to the ends of the first and second crease rollers for urging the first and second crease rollers toward each other.

10. A booklet maker comprising:

a first crease roller;

a second crease roller, the first crease roller and second crease roller arranged in longitudinal alignment with each other, the first and second crease rollers each having segmented outer surfaces including grooves formed therein, the grooves of the first crease roller aligning with the grooves of the second crease roller to form a plurality of gaps along the length of the first and second crease rollers;

a biasing device for urging the first and second crease rollers toward each other;

a spacing device disposed on at least one of the first and second crease rollers, the spacing device maintaining a minimum nip space between the first and second crease rollers, and the first and second crease rollers having a longitudinally extending outer surface, and the nip space being formed between the outer surfaces of the first and second crease rollers, the nip space extending along at least a length of the first and second crease rollers corresponding to the entire portion of the length through which the sheets travel, such that the first and second crease rollers do not engage each other along this length; and a movable crease blade disposed adjacent the nip space, the crease blade having a plurality of projections extending therefrom, the projections being aligned with and extending into the plurality of gaps.

11. The booklet maker of claim 10, wherein the spacing device includes a plurality of pitch rings.

12. The booklet maker of claim 11, wherein one of the plurality of pitch rings is disposed on the ends of the first and second crease rollers, the first and second crease rollers do not engage each other over the entire length of the first and second crease rollers extending between the pitch rings.

13. The booklet maker of claim 11 wherein the pitch rings include an annular structure having an opening extending through a center of the annular structure.

14. The booklet maker of claim 10, further including a stapler for securing a plurality of sheets together.

15. An apparatus for folding sheets comprising:

a first crease roller;

a second crease roller longitudinally aligned with the first crease roller, the first and second crease rollers each having segmented outer surfaces including grooves formed therein, the grooves of the first crease roller aligning with the grooves of the second crease roller to form a plurality of gaps along the length of the first and second crease rollers;

a spacing device separating the first and second crease rollers to form a nip space, between the outer surfaces of the first and second crease rollers, the nip space extending along at least a length of the first and second crease rollers corresponding to the entire portion of the length through which the sheets travel, such that the first and second crease rollers do not engage each other along this length;

a pair of biasing devices operably connected to the ends of the first and second crease rollers for urging the first and second crease rollers toward each other; and a crease blade disposed adjacent the nip space and adapted to urge the sheets toward the nip space, the crease blade having a plurality of projections extending therefrom, the projections being aligned with and extending into the plurality of gaps.

* * * * *